United States Patent [19]

Willis

[11] Patent Number: 4,745,686

[45] Date of Patent: May 24, 1988

[54] APPARATUS FOR IMPARTING ENHANCED DIRECTIONAL FLIGHT TO A PROJECTILE AND THE LIKE

[76] Inventor: John L. Willis, 1032 S. Berkeley, Turlock, Calif. 95380

[21] Appl. No.: 7,595

[22] Filed: Jan. 28, 1987

[51] Int. Cl.[4] ..... F41G 1/16

[52] U.S. Cl. ..... 33/254; 33/233; 33/261

[58] Field of Search ..... 33/233, 261, 244, 254, 33/252, 255, 256, 257, 258

[56] References Cited

U.S. PATENT DOCUMENTS

| | | | |
|---|---|---|---|
| 744,651 | 11/1903 | Vickery | 33/233 |
| 752,962 | 2/1904 | Eby . | |
| 1,330,002 | 2/1920 | Price | 33/254 |
| 2,092,356 | 9/1937 | Prather . | |
| 2,458,638 | 1/1949 | Pretzer . | |
| 2,563,193 | 8/1951 | Seymore . | |
| 2,730,806 | 1/1956 | Williams et al. | 33/261 |
| 2,741,029 | 4/1956 | Councill . | |
| 2,866,268 | 12/1958 | Collins . | |
| 2,904,888 | 9/1959 | Niesp . | |
| 2,970,380 | 2/1961 | Hill | 33/261 |
| 3,178,824 | 4/1965 | Callihoe . | |
| 3,886,667 | 6/1975 | Rueb . | |
| 4,429,468 | 2/1984 | Jimenez et al. | 33/261 |

FOREIGN PATENT DOCUMENTS

| | | | |
|---|---|---|---|
| 67400 | 7/1948 | Denmark | 33/261 |
| 599673 | 10/1925 | France | 33/261 |

*Primary Examiner*—William D. Martin, Jr.
*Attorney, Agent, or Firm*—Worrel & Worrel

[57] ABSTRACT

An apparatus for imparting enhanced directional flight to a projectile and the like which includes a discontinuous sleeve which is conformably dimensioned slidably to mate with the distal end of a firearm, and an adjustable sight alignment loop which forms a sight picture in the shape of the weapon's shot pattern, is slidably mounted into receiving engagement with the discontinuous sleeve to permit a marksman to adjust the weapon in an advantageous attitude with respect to a moving target before the weapon is discharged.

3 Claims, 2 Drawing Sheets

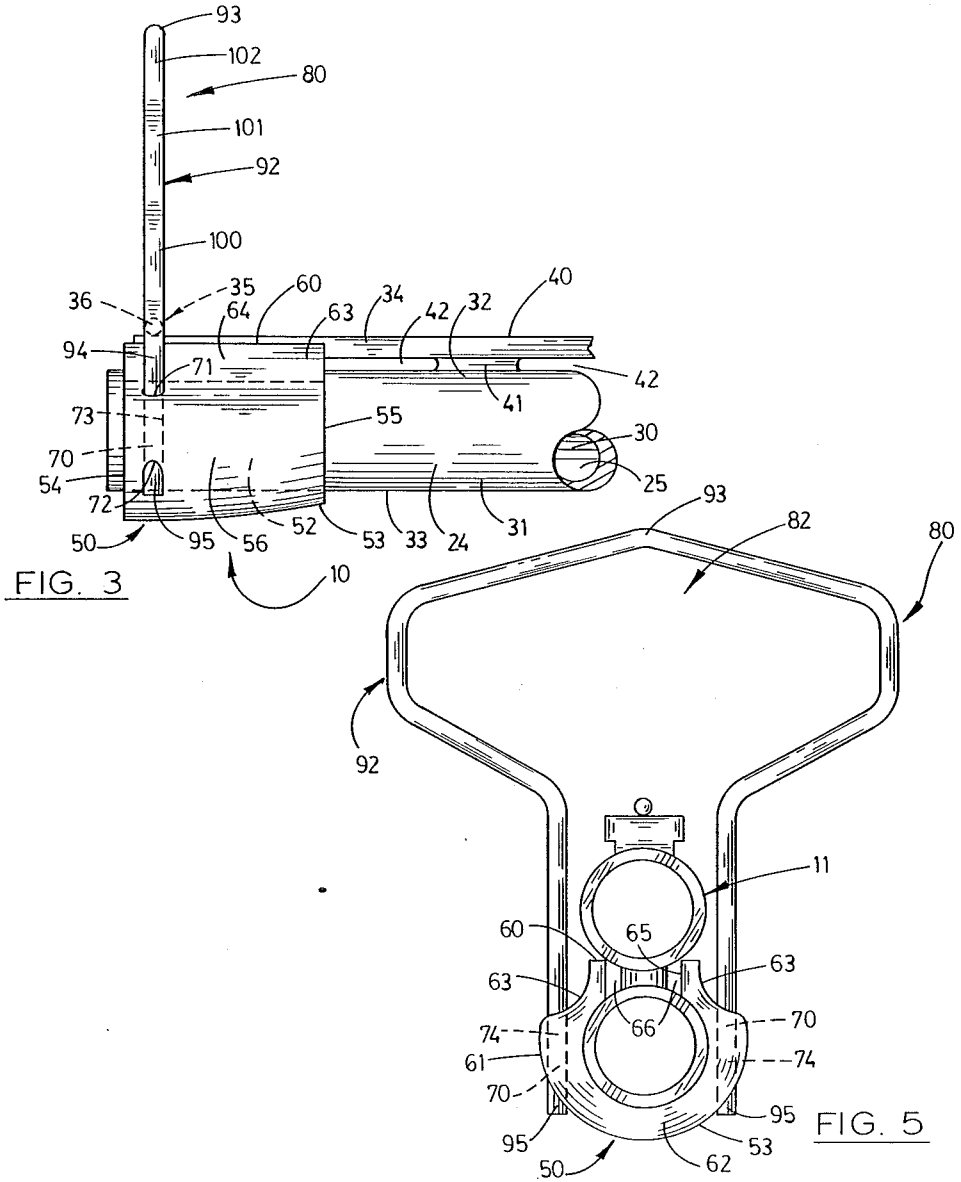
FIG. 3
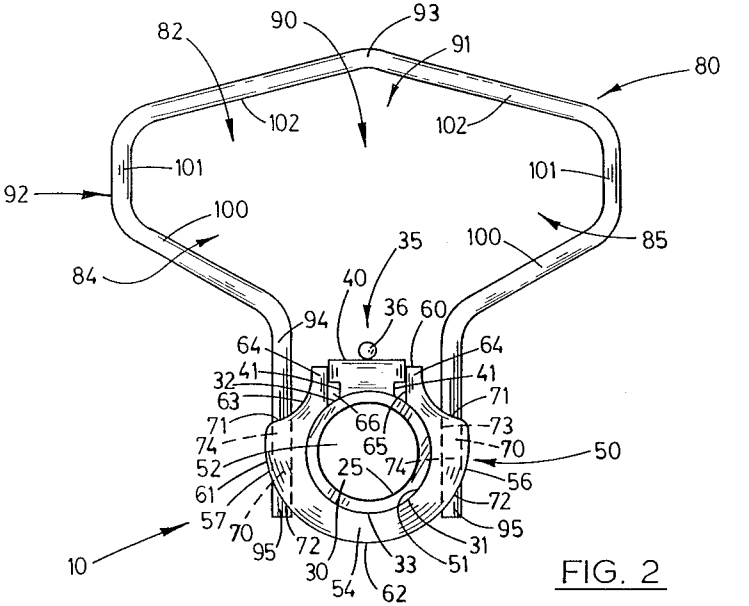
FIG. 2
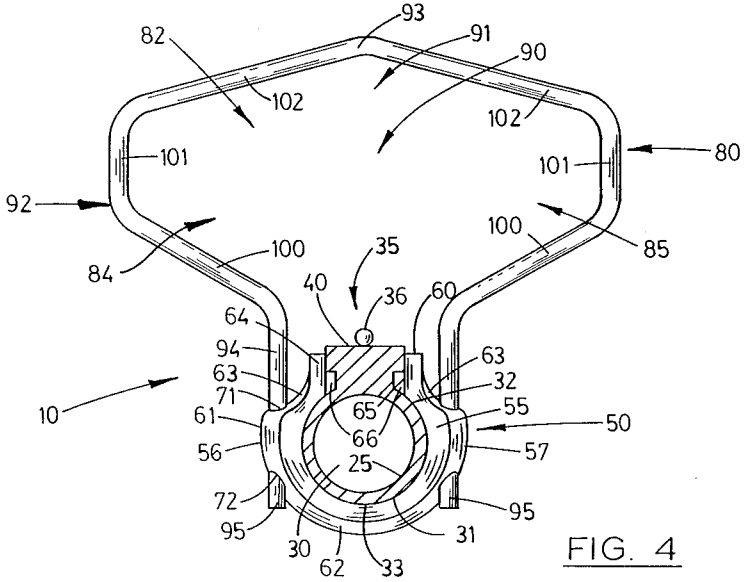
FIG. 4
FIG. 5

APPARATUS FOR IMPARTING ENHANCED DIRECTIONAL FLIGHT TO A PROJECTILE AND THE LIKE

BACKGROUND OF THE INVENTION

1. Field of the Invention

The present invention relates to an apparatus for imparting enhanced directional flight to a projectile and the like and more particularly to such an apparatus which is operable slidably to be received and mounted on the distal end of a firearm barrel, and which further has a hand adjustable sight alignment frame which permits a marksman to judge and thereafter to adjust the firearm in an advantageous attitude with respect to a moving target such that a projectile can be propelled in a preselected path of travel to strike the moving target, the apparatus imparting improved performance characteristics to the firearm upon which it is mounted in a configuration which is compact, light weight and easy to use.

2. Description of the Prior Art

The beneficial effects of employing variously designed auxiliary sighting and aiming assemblies for the purpose of improving the accuracy and shooting skills of hunting enthusiasts have long been known. More particularly marksmen have long recognized that auxiliary sighting and aiming devices were extremely helpful when they were utilized on moving targets such as various water fowl, birds, predators, and the like. As should be understood, the prior art is replete with numerous aiming and sighting devices which enable a marksman to "lead" a preselected moving target such that a projectile can be propelled in a preselected path of travel at the target to interact with it as it moves across the projectile's path of travel.

It is well known that the weapon or firearm of choice for marksmen who are shooting at a moving target is the shotgun. A shotgun utilizes a cartridge which commonly has a projectile composed of a multiplicity of small lead pellets or the like which, when propelled out of the weapon, form a shot pattern which has a distinctive shape and size. While the phenomena of forming a shot pattern is well known, few marksmen can rapidly estimate how large the shot pattern becomes as the shotgun pellets travel ever increasing distances away from the firearm. More particularly, marksmen have frequently missed moving targets that they have aimed and fired at because they "led" the moving target too much, or over estimated the size of the shot pattern, thus the target did not enter into the shot pattern.

While it is well recognized that the utilization of these various prior art aiming and sighting devices will improve somewhat the overall shooting accuracy and skills of some marksmen, the devices, however, suffer from a multiplicity of common drawbacks which have detracted from their usefulness. For example, nearly all of the prior art sighting and aiming assemblies employ, in one form or another, a rigid heavy gauge metal type clamp which is mounted to the distal end of the shotgun barrel. The clamp employed with these devices has traditionally been affixed to the barrel by a clamping screw which has been tightened, using a tool, to prevent the aiming assembly from becoming dismounted from its desired position on the barrel by the effect of the recoil generated by the firearm.

While these prior art aiming and sighting assemblies operate, as earlier mentioned, with a degree of success, they have a common shortcoming in that they frequently cause the shotgun to become unbalanced and thus difficult to use, or alternatively have obscured the fixed manufacturer's sights which have been mounted on the vent rib of the shotgun thus making it difficult or impossible to use these sights when shooting at targets which are moving in paths of travel substantially perpendicular to the marksman.

Still another significant problem with the prior art aiming and sighting assemblies results from characteristics inherent in their design inasmuch as the prior art devices have not been capable of indicating to a sportsman what the shape of the shot pattern generated by the shotgun is, and furthermore the prior art devices cannot be easily mounted or otherwise adjusted on the distal end of the barrel without the use of specialized tools.

Thus, it has long been known that it would be desirable to have an apparatus for imparting enhanced directional flight to a projectile and the like, and more particularly to an apparatus which is particularly well suited for use in improving the directional flight of a projectile which is fired out of a shotgun, the apparatus having a discontinuous sleeve which is conformably dimensioned for slidable mating receipt on the distal end of the shotgun barrel, the discontinuous sleeve slidably mounting a hand adjustable sight alignment frame or loop which is conformably dimensioned in the shape of the shot pattern produced by the shotgun.

SUMMARY OF THE INVENTION

Therefore, it is an object of the present invention to provide an improved apparatus for imparting enhanced directional flight to a projectile and the like.

Another object is to provide such an apparatus which is particularly well suited to improving the directional control of the flight of a projectile which is fired from a shotgun.

Another object is to provide such an apparatus which has a configuration which is conducive to the attainment of improved precision by utilizing both eyes when employing the device.

Another object is to provide such an apparatus which is conformably dimensioned to define a sight picture which is in the shape of the firearm's shot pattern.

Another object is to provide such an apparatus which has a discontinuous sleeve that is slidably mounted in a secure fashion on the distal end of the shotgun barrel without the use of any tools.

Another object of the present invention is to provide an apparatus which enhances the directional flight of a projectile being propelled at a moving target while simultaneously not affecting the balance of the shotgun, or the ability of the marksman to swing the shotgun in a consistent smooth predetermined path of travel while the marksman acquires the correct sight alignment and sight picture necessary for an accurate shot.

Another object is to provide such an apparatus which has a sight alignment frame or loop which is slidably adjustable in various vertical attitudes to permit modification of the sight picture.

Another object is to provide such an apparatus which is characterized by simplicity of design, ease of employment, and economy of construction.

Further objects and advantages are to provide improved elements and arrangements thereof in an apparatus for the purposes described which is dependable, durable, and effective in accomplishing its intended purposes.

These and other objects and advantages are achieved in an apparatus for imparting enhanced directional flight to a projectile and the like of the present invention wherein, in the preferred embodiment, the apparatus is conformably dimensioned to be slidably received and securely mounted on the distal end of a shotgun barrel, the apparatus having a discontinuous sleeve which slidably mounts an adjustable sight alignment loop, the adjustable sight alignment loop defining a sight picture which depicts the shot pattern of the shotgun, the apparatus permitting a marksman to improve the directional flight of the projectile fired from the shotgun by permitting the marksman to adjust the position of the shotgun to allow the preselected target to enter into the shotgun's shot pattern, thus achieving enhanced firearm performance.

BRIEF DESCRIPTION OF THE DRAWINGS

FIG. 2 is a somewhat enlarged, front elevation of the apparatus of the subject invention with a portion of the underlying structure thereof shown in phantom lines.

FIG. 3 is a somewhat enlarged side elevation of the apparatus of the subject invention with some underlying structure thereof shown in phantom lines.

FIG. 4 is a somewhat enlarged rear elevation of the apparatus of the subject invention taken on line 4—4 of FIG. 1.

FIG. 5 is a somewhat enlarged front elevational view of the apparatus of the subject invention mounted on the distal end of an "over and under" shotgun with a portion of the underlying structure thereof shown in phantom lines.

DESCRIPTION OF THE PREFERRED EMBODIMENT

Figures 1, 6:
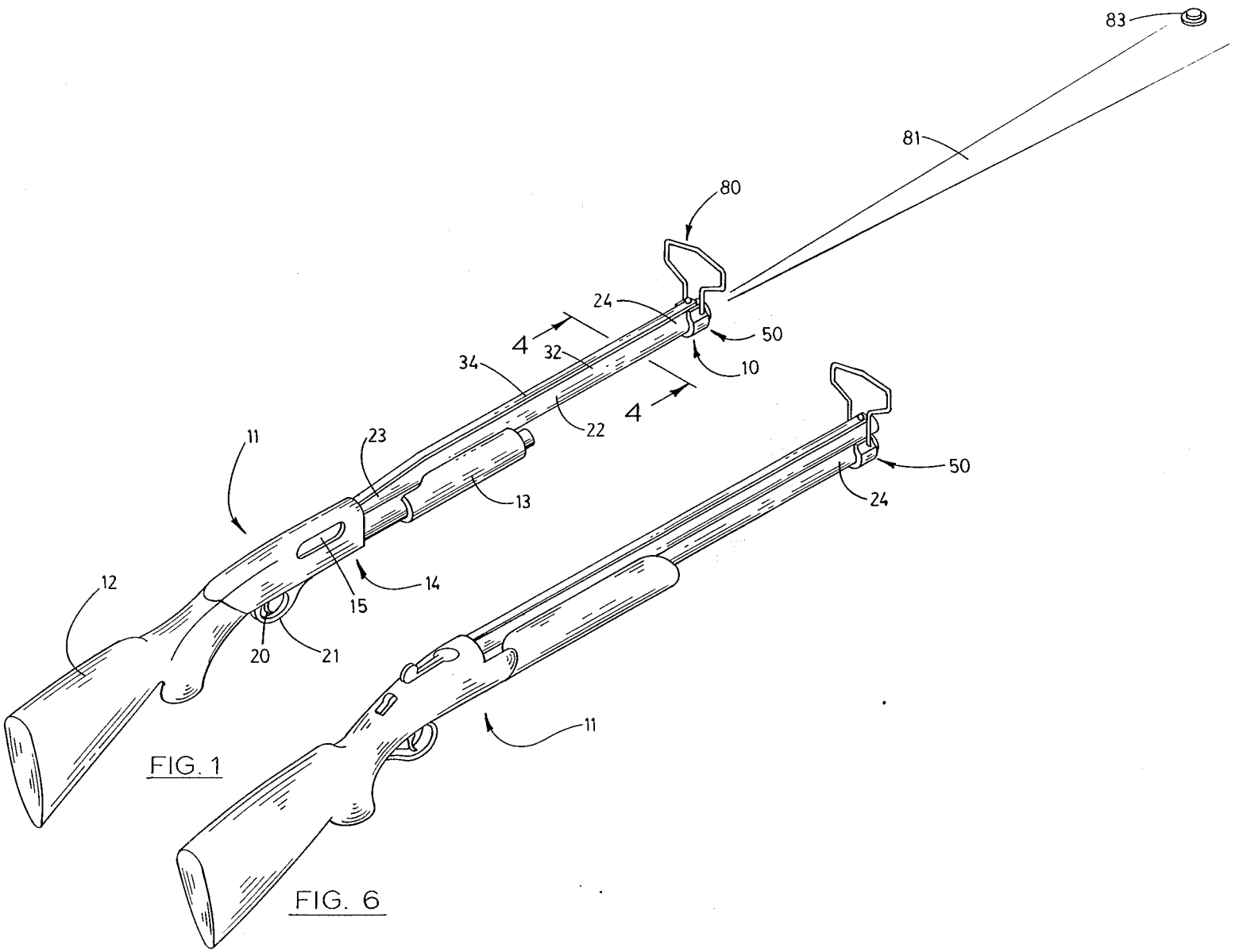
FIG. 1 is a perspective view of the apparatus for imparting enhanced directional flight to a projectile and the like of the subject invention shown in a typical operative configuration slidably mounted on the distal end of a conventionally designed shotgun.
FIG. 6 is a perspective view of the apparatus for imparting enhanced directional flight to a projectile shown in a typical operative configuration mounted on the distal end of an "over and under" shotgun.

Referring more particularly to the drawings, the apparatus for imparting enhanced directional flight to a projectile and the like embodying the principles of the present invention is generally indicated by the numeral 10 in FIG. 1. As shown therein, the apparatus 10 is detachably secured on a weapon or firearm which is herein depicted as a shotgun 11.

As should be understood, the shotgun 11 is of conventional design having a shoulder stock 12 which is conformably dimensioned to be held into the marksman's shoulder, not shown, when the shotgun is discharged. The shotgun further has a pump handle 13 which is slidably operable, when moved in the direction of the shoulder stock, to eject a spent shotgun cartridge (not shown) from the breech 14, through the ejection port 15. The pump handle is further operable, when slidably moved in a direction away from the shoulder stock to strip a live shotgun cartridge from the magazine (not shown) and to move it into mating receipt with the receiver group of the shotgun (not shown).

The shotgun 11 is discharged by depressing the trigger 20 which is enclosed within a trigger guard 21. The shotgun has a barrel 22, which is of conventional design. The barrel 22 has a proximal end 23, which is affixed in registry with the receiver group (not shown) of the shotgun, and a distal end 24. The barrel has an inside surface 25, which forms the bore 30 of the barrel, an outside surface 31, a top portion 32, and a bottom portion 33. As best understood by reference to FIGS. 1 and 3, the top portion 32 of the barrel 22 mounts a vent rib 34 which is of conventional design. As should be understood the vent rib operates to divert or otherwise diffuse heat energy which is generated by the shotgun 11, when the shotgun is discharged. The vent rib, as should be appreciated, channels the heat produced, laterally, with respect to the barrel, and thus permits the marksman to acquire an unimpaired view of the manufacturer's fixed gun sight 35 which is herein illustrated as a bead 36 that is mounted on the distal end 24 of the barrel 22. The vent rib has a top surface 40 and vertically disposed side walls 41. The side walls of the vent rib have formed therein a plurality of vents which channel the heat produced upon discharge of the firearm away from the top portion 32 of the barrel 22. The bead 36 is affixed by welding or the like to the top surface 40 in the area of the distal end of the barrel.

As best understood by reference to FIGS. 2 and 3, the apparatus 10 has a discontinuous sleeve 50, which is fashioned, out of any number of rigid, lightweight, resilient, and heat resistant materials, such as hard rubber, nylon, or plastic, into a generally frusto-conical configuration. The discontinuous sleeve has an inside surface 51, which defines a channel or annular bore 52 of substantially uniform dimension which is conformably adapted slidably to mate with and closely hold the barrel 22 in the vicinity of the distal end 24 thereof. The discontinuous sleeve further has an outside surface 53, a first end 54, a second end 55, a left side 56, and an opposite right side 57.

As best illustrated in FIG. 2, the apparatus 10 has an apical portion 60, a thickened mid-portion 61, and a basal portion 62. Formed into the apical portion of the discontinuous sleeve is a pair of spaced, substantially parallel horizontally disposed channels 63. The channels define a pair of vertically disposed walls 64 which are mounted in parallel fixed spaced relation with respect to each other. Each of the walls 64 has a substantially planar inside surface 65 which defines a passageway 66 of predetermined dimensions. As best understood by reference to FIG. 2, the passageway 66 is conformably dimensioned slidably to receive and closely hold the vent rib 34 which is mounted on the top portion 32 of the barrel 22. As should be appreciated, the apparatus 10 is held in a fixed predetermined attitude on the distal end 24 of the barrel by the effect of friction which is developed between the inside surface 51 of the discontinuous sleeve 50 and the outside surface 31 of the barrel. When the apparatus 10 is slidably mounted on the distal end of the barrel, the passageway 66 prevents the discontinuous sleeve from rotating about the barrel because it engages the vent rib 34.

The apparatus 10 has formed into the thickened mid-portion 61, in an attitude closely adjacent to the second end of the discontinuous sleeve 50, a pair of vertically disposed substantially parallel receiving conduits 70. As should be understood, the pair of conduits 70 which are positioned individually on the left and right side 56 and 57, respectively, have a predetermined dimension which permits them telescopingly to receive and securely mate with the sight alignment loop which will hereinafter be described in greater detail. Each conduit has a first end 71, a second end 72, and an inside surface 73. The inside surface 73 defines a passageway indicated numerically by the number 74 which closely holds the sight alignment loop or frame indicated generally by the number 80.

The sight alignment loop or frame 80 is slidably received into mating engagement with the pair of conduits 70. The sight alignment loop 80, as herein described, is formed into a substantially hexagonal shape, it being understood that the hexagonal shape is the general shape of the shot pattern 81 that is produced by the shotgun 11. However, it should be appreciated that the sight alignment loop can be shaped in assorted different shapes and sizes to accommodate the shot pattern produced by shotguns of different gauges, and barrel configurations. Moreover, it should be understood that the discontinuous sleeve can be modified in such a fashion as to accommodate "over and under" shotguns. As best seen by reference to FIGS. 5 and 6, the discontinuous sleeve 50 can be slidably received on the distal end 24 of a shotgun 11 which is manufactured in the configuration of the "over and under" style. As should be understood, the dimension of the passageway 66, which is defined by the inside surface 65 of the discontinuous sleeve 50 is somewhat wider to permit it to be slidably received on the lower of the two barrels 22 as viewed in FIG. 5. The sight alignment loop defines a sight picture or window 82, through which a marksman, not shown, can view a target 83, which is herein illustrated as a clay pigeon, and thereafter adjust the sight picture to the moving target for the purpose of "leading" the target a sufficient distance and thus allow the marksman to discharge the weapon at an opportune time such that the target moves through the shot pattern's path of travel.

The sight picture or window 82 which is defined by the sight alignment loop 80 permits a marksman to "judge" or "read" a moving target from four points of reference. Moreover, the size and shape of the sight picture allows a marksman to utilize both eyes when forming the desired sight picture. As best illustrated by reference to FIG. 4, a first point of reference 84 would be used when the target is moving from left to right as seen in this view. A second point of reference 85 would be utilized when the target is moving from right to left as seen in the same view. A third point of reference 90 would be used when a target was moving directly at and in an attitude substantially perpendicular to the marksman, a fourth point of reference 91 would be employed when the target was moving away from and in an attitude substantially perpendicular to the marksman.

The sight alignment loop or frame 80 has a main body 92 which has an apex 93 and a base portion 94. Extending from the base portion 94 is a pair of dependent legs 95 which are mounted in fixed substantially parallel relationship. The pair of legs 95 are conformably dimensioned to be telescopically received into mating relationship with the pair of conduits 70 which are formed into the thickened mid-portion 61 of discontinuous sleeve 50. As will be understood, the dependent legs permit the sight alignment loop 80 to be hand adjusted in various vertical attitudes while it is mounted on the distal end 24 of the barrel 22. Thus, it should be appreciated that the sight picture 82 can be tailored to accommodate various shooting styles, and marksmen preferences. As should be understood, the dependent legs will vary in length depending upon whether the apparatus will be used on a single barrel shotgun 11 or an "over and under" shotgun. As illustrated in FIGS. 5 and 6, the dependent legs of the sight alignment loop used on the "over and under" shotgun will be somewhat slightly longer as compared with the dependent legs of the sight alignment loop used on a single barrel shotgun.

The main body 92 of the sight alignment loop 80 typically will be formed out of an appropriate gauge wire which will be formed into the shotgun's 11 shot pattern. As seen in FIG. 2, the main body has a pair of first courses 100 which diverge at substantially equal angles from the base portion 92 to join a pair of substantially parallel second courses 101 which are formed into the main body. The pair of second courses are connected to a pair of converging third courses 102 which meet at the apex 92.

OPERATION

The operation of the described embodiment of the present invention is believed to be readily apparent and is briefly summarized at this point.

The apparatus 10 for imparting enhanced directional flight to a projectile and the like is best understood by reference to FIG. 1. As shown therein, the apparatus 10 has a discontinuous sleeve 50 which is mounted slidably into secure mating receipt onto the distal end 24 of the barrel 22. The discontinuous sleeve slidably receives the sight alignment loop which is formed into the shape of the shotgun's 11 shot pattern 81.

To employ the apparatus 10, the marksman (not shown) "frames" the moving target 83 within the sight picture 82 created by the sight alignment loop 80 and thereafter adjusts the sight picture by utilizing the points of reference that the sight picture creates, 84, 85, 90, and 91, respectively. When the sight picture is appropriate, the marksman squeezes the trigger 20 which discharges the shotgun 11. The adjustment of the sight picture in the fashion described insures that the marksman has "led" the target a sufficient distance such that the target moves through the shot pattern.

Therefore, the apparatus for imparting enhanced directional flight to a projectile and the like of the present invention is particularly well suited for use by a marksman to adjust a weapon quickly and accurately to a moving target which is being shot at; is adapted operatively to slidably mount on and be secured to the distal end of a barrel of a firearm without the use of any specialized tools, is easily maintained and stored prior to usage; and can be constructed and sold at a nominal price when compared with numerous prior art aiming and sighting assemblies which were previously employed for approximately the same purpose.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. Apparatus for imparting improved directional flight to a projectile and wherein the projectile is aimed and propelled at a moving target by a firearm having a barrel which mounts a vent rib, the apparatus comprising a discontinuous sleeve having an inside and outside surface, a first and second end, and an apical, basal and a thickened mid-portion, said discontinuous sleeve having formed in the apical portion a pair of horizontally disposed channels, each channel defining a substantially vertical wall, each wall being positioned in spaced substantially parallel relationship with respect to each other, said walls each having an inside surface which defines a passageway which is conformably dimensioned slidably to receive and hold the vent rib of the firearm, said inside surface of the discontinuous sleeve further defining an annular bore of uniform dimensions which is conformably adapted slidably to receive and hold the barrel of the firearm, said thickened mid-portion further having formed therein in an attitude closely adjacent to the second end a pair of parallel substantially vertically disposed conduits; and a hexagonal shaped rigid sight alignment loop having a pair of dependent legs is slidably mounted into receiving relationship with the vertically disposed conduits, the sight alignment loop defining a sight picture that permits enhanced firearm performance.

2. The apparatus of claim 1 wherein the discontinuous sleeve is substantially frusto-conical in shape, said discontinuous sleeve further having an annular bore of a dimension which permits the discontinuous sleeve to be mounted in a predetermined attitude on the firearm barrel by the effect of friction.

3. The apparatus of claim 2 wherein the sight alignment loop is hand adjustable, said sight alignment loop being held in a predetermined attitude by the effect of friction, and the sight picture defined by the hand adjustable loop provides four points of reference to permit a marksman to judge a moving target.

* * * * *